US009180510B2

(12) United States Patent
Sugata et al.

(10) Patent No.: US 9,180,510 B2
(45) Date of Patent: Nov. 10, 2015

(54) ELECTRIC RIVETER

(71) Applicant: LOBTEX CO., LTD., Higashi-Osaka (JP)

(72) Inventors: Tsuyoshi Sugata, Higashi-Osaska (JP); Masahiro Yokota, Kyoto (JP)

(73) Assignee: LOBTEX CO., LTD., Osaka (JP)

( * ) Notice: Subject to any disclaimer, the term of this patent is extended or adjusted under 35 U.S.C. 154(b) by 0 days.

(21) Appl. No.: 14/379,633

(22) PCT Filed: Feb. 18, 2013

(86) PCT No.: PCT/JP2013/053850
§ 371 (c)(1),
(2) Date: Aug. 19, 2014

(87) PCT Pub. No.: WO2013/125481
PCT Pub. Date: Aug. 29, 2013

(65) Prior Publication Data

US 2015/0033525 A1 Feb. 5, 2015

(30) Foreign Application Priority Data

Feb. 23, 2012 (JP) ..... 2012-037594

(51) Int. Cl.

| | |
|---|---|
| ***B21J 15/26*** | (2006.01) |
| ***B21J 15/32*** | (2006.01) |
| ***B21J 15/10*** | (2006.01) |
| ***B21J 15/04*** | (2006.01) |

(52) U.S. Cl.
CPC ..... *B21J 15/326* (2013.01); *B21J 15/043* (2013.01); *B21J 15/105* (2013.01); *B21J 15/26* (2013.01)

(58) Field of Classification Search
CPC ..... B21J 15/0326; B21J 15/26; B21J 15/105; B21J 15/043
USPC ..... 29/243.521–243.525
See application file for complete search history.

(56) References Cited

U.S. PATENT DOCUMENTS

| | | | | |
|---|---|---|---|---|
| 4,454,746 | A | | 6/1984 | Schwab |
| 4,541,266 | A | | 9/1985 | Totsu |
| 4,796,794 | A | | 1/1989 | Schultz et al. |
| 4,807,498 | A | | 2/1989 | Kleiser et al. |
| 5,136,873 | A | * | 8/1992 | Hopkins et al. ..... 72/391.6 |
| 5,473,805 | A | * | 12/1995 | Wille ..... 29/243.526 |
| 5,544,407 | A | | 8/1996 | Ohuchi et al. |
| 5,651,169 | A | | 7/1997 | Ohuchi et al. |

(Continued)

FOREIGN PATENT DOCUMENTS

| | | | |
|---|---|---|---|
| CN | 201192722 | Y | 2/2009 |
| CN | 102233402 | A | 11/2011 |

(Continued)

*Primary Examiner* — David B Jones
(74) *Attorney, Agent, or Firm* — The Webb Law Firm

(57) ABSTRACT

Provided is an electric riveter including a housing internally provided with a drive unit configured to drive an actuator that withdraws a mandrel from a rivet, and a mandrel collector that collects mandrels. The actuator includes a cover having a proximal end coupled to the housing, a nozzle provided at a distal end of the cover, and a jaw provided in the cover. The drive unit includes an electric motor that drives the actuator. The housing includes a drive housing unit connected to a handle having a rod shape. The electric motor is arranged at a position deviated from the center of grip of the handle in a direction about an axis line extending along the center line of the cover.

2 Claims, 6 Drawing Sheets

(56) References Cited

U.S. PATENT DOCUMENTS

| | | | | |
|---|---|---|---|---|
| 6,141,849 | A * | 11/2000 | Honsel et al. | 29/243.521 |
| 6,145,360 | A * | 11/2000 | Honsel et al. | 72/19.8 |
| 6,237,390 | B1 * | 5/2001 | Honsel et al. | 72/449 |
| 6,684,470 | B1 * | 2/2004 | Joux | 29/243.521 |
| 6,886,226 | B1 * | 5/2005 | Dear et al. | 29/243.53 |
| 8,443,512 | B2 * | 5/2013 | Masugata | 29/715 |
| 2010/0139066 | A1 | 6/2010 | Chen | |
| 2011/0271504 | A1 | 11/2011 | Preti | |

FOREIGN PATENT DOCUMENTS

| | | | |
|---|---|---|---|
| EP | 2113317 | A1 | 11/2009 |
| JP | 586745 | A | 1/1983 |
| JP | 59153538 | A | 9/1984 |
| JP | 6466034 | A | 3/1989 |
| JP | 5200476 | A | 8/1993 |
| JP | 6198379 | A | 7/1994 |
| JP | 2001150364 | A | 6/2001 |
| JP | 2003112230 | A | 4/2003 |
| JP | 2003311363 | A | 11/2003 |

* cited by examiner

ELECTRIC RIVETER

CROSS-REFERENCE TO RELATED APPLICATIONS

This application is the U.S. national phase of International Application No. PCT/JP2013/053850 filed Feb, 18, 2013, and claims priority to Japanese Patent Application No. 2012-037594 filed Feb. 23, 2012, the disclosures of which are hereby incorporated in their entirety by reference.

FIELD

The present invention relates to an electric riveter that is used when riveting two or more members.

BACKGROUND

Riveters powered by electricity (hereinafter, referred to as electric riveters) have been conventionally provided as a riveter that is used when riveting two or more members. Such an electric riveter includes an actuator for withdrawing a mandrel inserted through a rivet, a drive unit for driving the actuator, and a housing internally provided with the actuator and the drive unit.

The actuator includes a cylindrical cover having a distal end and a proximal end, in which the proximal end is coupled to the housing, a cylindrical jaw case that has a distal end and a proximal end and is provided inside the cover concentrically therewith so as to be movable along the center of the cover, a nozzle that is provided at the distal end of the cover and includes a rivet insertion hole formed concentrically with the jaw case, and a jaw that is provided inside the distal end of the jaw case and is configured to be capable of clamping the mandrel. Thus, the actuator is configured to allow the mandrel inserted through a rivet shaft insertion hole to reach the jaw within the cover (jaw case).

The drive unit includes an electric motor having an output shaft, and a drive transmission mechanism that transmits the driving force of the electric motor to the actuator. The drive transmission mechanism includes a feed screw mechanism that moves the jaw case within the cover. The feed screw mechanism includes an internally threaded member and an externally threaded member that is screwed into the internally threaded member concentrically therewith.

One of the internally threaded member and the externally threaded member of the feed screw mechanism is coupled directly or indirectly to the proximal end of the jaw case. The other of the internally threaded member and the externally threaded member of the feed screw mechanism of the drive transmission mechanism is coupled directly or indirectly to the output shaft of the electric motor concentrically therewith. This allows the other of the internally threaded member and the externally threaded member to rotate in the drive transmission mechanism by receiving the driving force of the electric motor. Then, the one of the internally threaded member and the externally threaded member moves in a direction in which the center line of the externally threaded member extends. Accordingly, the jaw case is configured to move in the same direction as the one of the internally threaded member and the externally threaded member moves by the driving force of the electric motor. Similarly, the jaw provided inside the jaw case is also configured to move in the same direction as the one of the internally threaded member and the externally threaded member moves.

The housing has a handle having a first end and a second end on the opposite side of the first end, and a drive housing unit that houses the drive unit and is connected to the first end of the handle. The handle is formed so that the center line extending from the first end to the second end (or from the second end to the first end) serves as the center of gripping when an operator grips the handle. The handle is provided with a trigger switch for switching between supplying and cutting off power to the electric motor. The trigger switch is arranged within a region of the handle where the operator grips it.

The drive housing unit of the housing houses the feed screw mechanism (the internally threaded member and the externally threaded member) so that the axial cores of the internally threaded member and the externally threaded member extend in a direction intersecting a direction in which the center line of the handle (the center of grip) extends. Further, the drive housing unit of the housing also houses the electric motor so as to be capable of transmitting the driving force to the feed screw mechanism.

The proximal end of the cover is coupled to the drive housing unit of the housing so as to be concentric with the feed screw mechanism housed therein. That is, the drive housing unit has the first end and the second end on the opposite side of the first end in the direction intersecting the direction in which the center line of the handle (the center of grip) extends. The proximal end of the cover is coupled to the first end of the drive housing unit so as to be concentric with the feed screw mechanism housed therein.

In such an electric riveter of this type, an operator operates the trigger switch in the state where the mandrel inserted through the rivet is inserted through the rivet shaft insertion hole when crimping the rivet. This causes the feed screw mechanism to receive a driving force from the electric motor. Then, the jaw clamping the mandrel moves from the distal end side of the cover to the proximal end side of the cover. Following this, the rivet is crimped, and the mandrel is withdrawn from the rivet (see Patent Literature 1).

Meanwhile, since it is cumbersome to remove a mandrel withdrawn from a rivet by hand each time when crimping the rivet, an electric riveter including a mandrel collector that continuously collects mandrels withdrawn from rivets is provided (see Patent Literature 2). In such an electric riveter, the mandrel collector includes a pin collection path having a first opening end and a second opening end on the opposite side thereof, and a collection tank that houses mandrels therein.

The pin collection path is concentric or substantially concentric with the jaw case and the feed screw mechanism. That is, the pin collection path passes through the externally threaded member of the feed screw mechanism so as to extend along the center of the jaw case and the feed screw mechanism. The pin collection path opens at the first opening end into the jaw, and opens at the second opening end into the second end of the drive housing unit. Thus, the collection tank is coupled to the second end of the drive housing unit, thereby allowing the internal space of the collection tank to communicate with the second opening end of the pin collection path.

Accordingly, in the electric riveter of this type, the electric motor is arranged between the feed screw mechanism of the drive unit and the gripping position of the handle, so as to allow the second opening end of the pin collection path to open. That is, in the electric riveter of this type, it is impossible to allow the second opening end of the pin collection path to open, if the actuator (feed screw mechanism) and the electric motor are arranged in the same raw. Therefore, the electric motor of the electric riveter of this type has an output shaft that extends in parallel to the feed screw mechanism and is located between the feed screw mechanism and the gripping position of the handle in a direction in which the center of grip extends.

Further, the drive unit of the electric riveter with the aforementioned configuration further includes a gear mechanism that transmits the driving force of the electric motor to the internally threaded member. The gear mechanism includes a first gear wheel that is coupled to the output shaft of the electric motor, and a second gear wheel that is attached to the other of the internally threaded member and the externally threaded member. The first gear wheel and the second gear wheel mesh with each other directly or via an intermediate gear wheel.

In the electric riveter with the aforementioned configuration, the proximal end of the jaw case is coupled to the externally threaded member of the feed screw mechanism. Thus, the electric riveter with the aforementioned configuration is configured so that the driving force of the electric motor is transmitted to the one of the internally threaded member and the externally threaded member via the gear mechanism.

Therefore, as the other of the internally threaded member and the externally threaded member rotates in conjunction with the electric motor, the jaw moves together with the one of the internally threaded member and the externally threaded member. This causes the mandrel to be withdrawn from the rivet after the rivet is crimped. Then, when the jaw releases the clamping of the mandrel, the mandrel is collected into the collection tank, passing through the pin collection path. Accordingly, the electric riveter with the aforementioned configuration makes it possible to continuously crimp a plurality of rivets, without the need to remove a mandrel each time when crimping a rivet.

CITATION LIST

Patent Literature

Patent Literature 1: JP 2003-112230 A

Patent Literature 2: JP 5(1993)-200476 A

SUMMARY

Technical Problem

In the electric riveter with the aforementioned configuration, the electric motor is arranged between the feed screw mechanism of the drive unit and the gripping position of the handle so as to collect mandrels withdrawn from rivets, as described above.

Accordingly, in the electric riveter with the aforementioned configuration, there is a large distance between the position where the operator grips when crimping a rivet (the region in the handle where the trigger switch is present) and the position where a mandrel is inserted (the position of the nozzle). That is, in the electric riveter with the aforementioned configuration, the gripping position of the handle and the insertion position of the mandrel are spaced apart from each other, due to the intervention of the electric motor. Therefore, in the electric riveter with the aforementioned configuration, access of the nozzle (a rivet having a rivet insertion hole through which a mandrel is inserted) to the position where a member subject to riveting is fastened is difficult, which is a problem.

In view of such actual circumstances, the present invention aims to provide an electric riveter capable of improving operability, in addition to collecting mandrels to be withdrawn when crimping rivets.

Solution to Problem

An electric riveter according to the present invention includes: an actuator for withdrawing a mandrel inserted through a rivet; a drive unit for driving the actuator; a housing internally provided with the actuator and the drive unit; and a mandrel collector for collecting the mandrel withdrawn from the rivet, wherein the actuator includes: a cylindrical cover having a distal end and a proximal end; a cylindrical jaw case having a distal end and a proximal end, the jaw case being provided inside the cover concentrically therewith so as to be movable along a direction in which a center line of the cover extends; a nozzle provided at the distal end of the cover, the nozzle having a rivet insertion hole that is formed concentrically with the jaw case; and a jaw provided inside the distal end of the jaw case, the jaw being capable of cramping the mandrel, the drive unit includes: an electric motor; and a drive transmission mechanism configured to transmit a driving force of the electric motor to the actuator so as to move the jaw case, the housing includes: a handle having a first end and a second end on the opposite side of the first end; and a drive housing unit configured to house the drive unit, the drive housing unit being connected to the first end of the handle, the proximal end of the cover is coupled to the drive housing unit so that the cover extends in a direction intersecting the center of grip of the handle, the mandrel collector includes: a pin collection path having a first opening end and a second opening end on the opposite side of the first opening end; and a collection tank configured to house the mandrel, the pin collection path has the first opening end opening into the jaw and the second opening end communicating with an internal space of the collection tank, and the electric motor of the drive unit is arranged at a position deviated from the center of grip of the handle in a circumferential direction about the pin collection path.

According to one aspect of the present invention, it is preferable that the collection tank be configured to be attachable to and detachable from the drive housing unit, and be attached to the drive housing unit so that the second opening end of the pin collection path is located above the center of the internal space of the collection tank.

DESCRIPTION OF EMBODIMENTS

Figure 1:
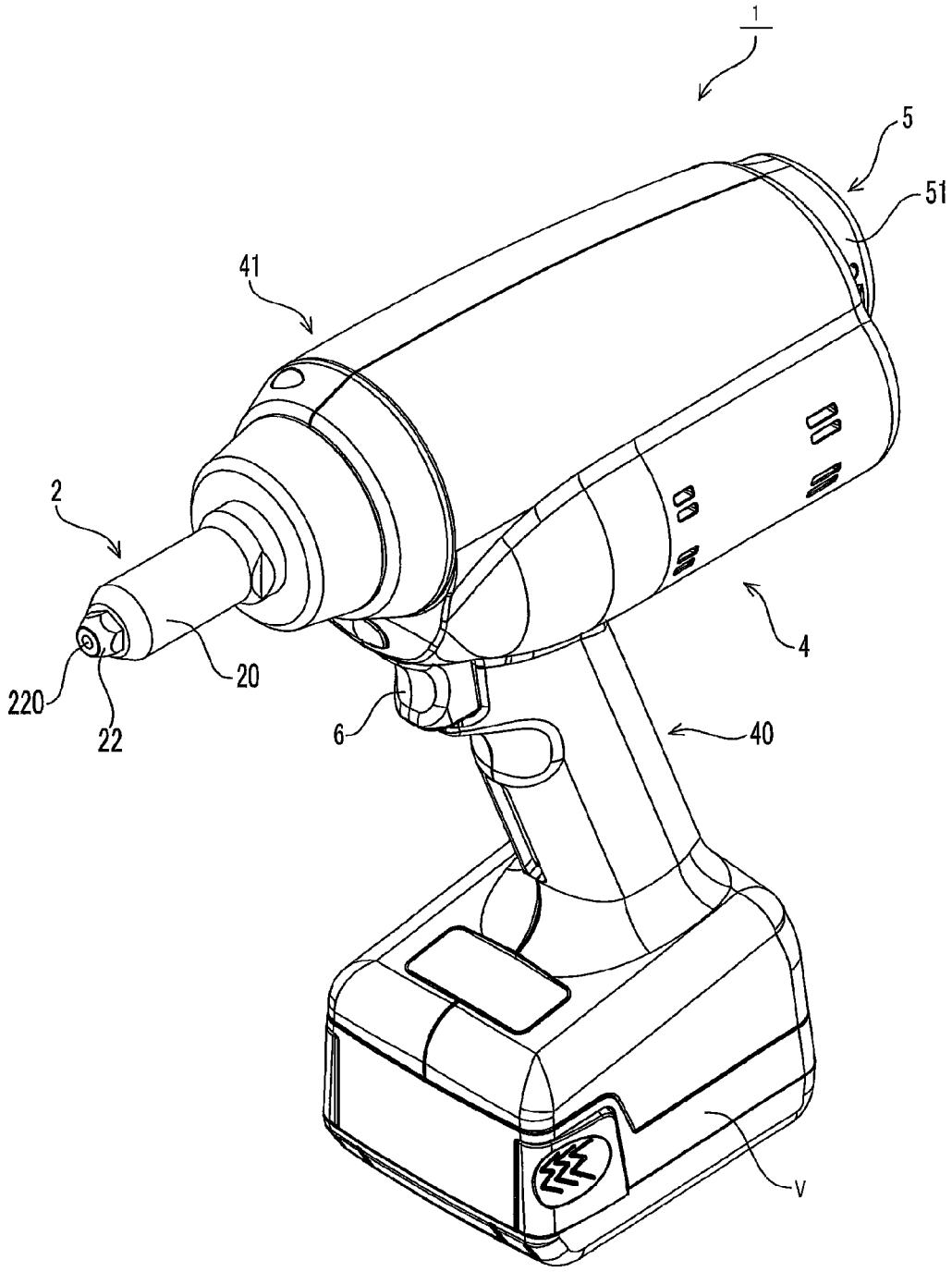
FIG. 1 is a perspective view of an electric riveter according to one embodiment of the present invention.
Figure 2:
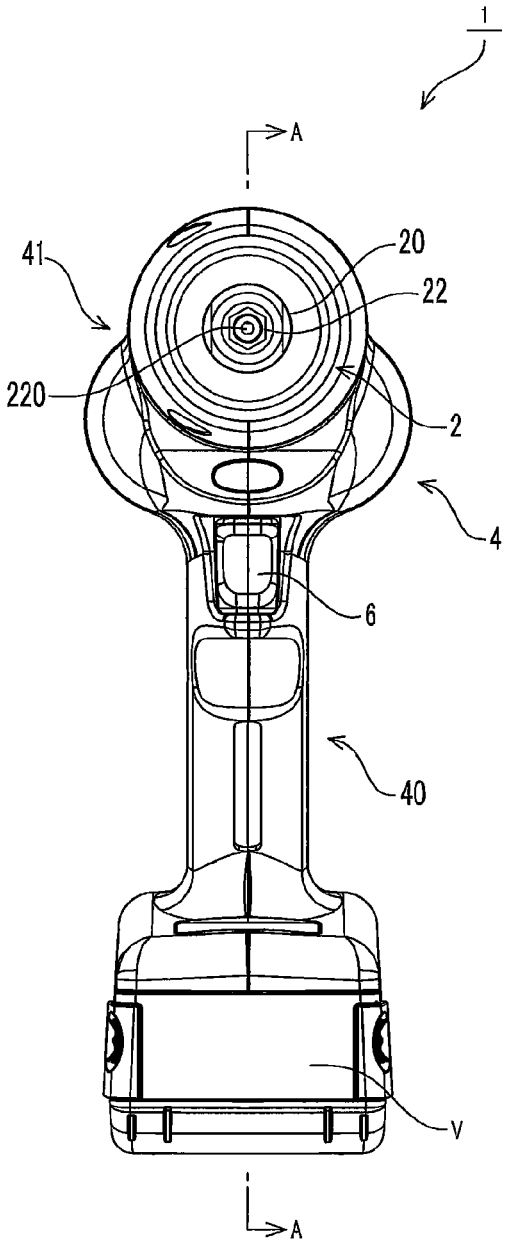
FIG. 2 is a front view of the electric riveter according to the embodiment.
Figure 3:
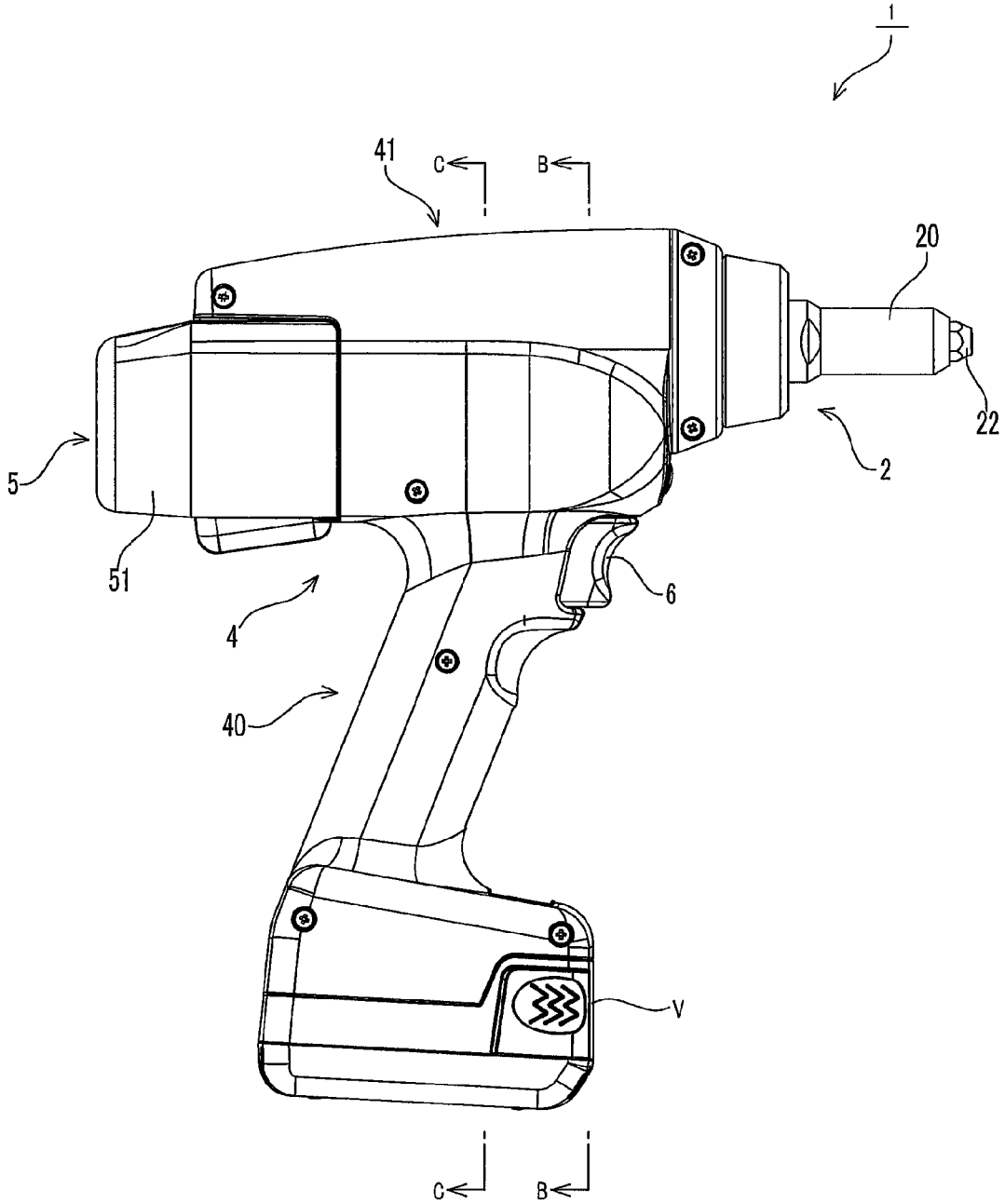
FIG. 3 is a left side view of the electric riveter according to the embodiment.

Hereinafter, an electric riveter according to one embodiment of the present invention is described with reference to the attached drawings.

The electric riveter according to this embodiment is used for crimping a cylindrical rivet having a flange with a large diameter at one end by withdrawing a mandrel in the form of a shaft that has been inserted through the rivet from the other end side to the one end side and crimping the rivet at the other end.

As shown in FIG. 1 to FIG. 5, the electric riveter according to this embodiment includes an actuator 2 for withdrawing the mandrel inserted through the rivet, a drive unit 3 for driving the actuator 2 (see FIG. 4 and FIG. 5), and a housing 4 internally provided with the actuator 2 and the drive unit 3. Further, an electric riveter 1 includes a mandrel collector 5 for collecting the mandrel withdrawn from the rivet (see FIG. 3 and FIG. 4).

In the electric riveter 1 according to this embodiment, the housing 4 includes a handle 40 having a first end and a second end on the opposite side of the first end, and a drive housing unit 41 that houses the drive unit 3 and is connected to the first end of the handle 40.

Figure 4:
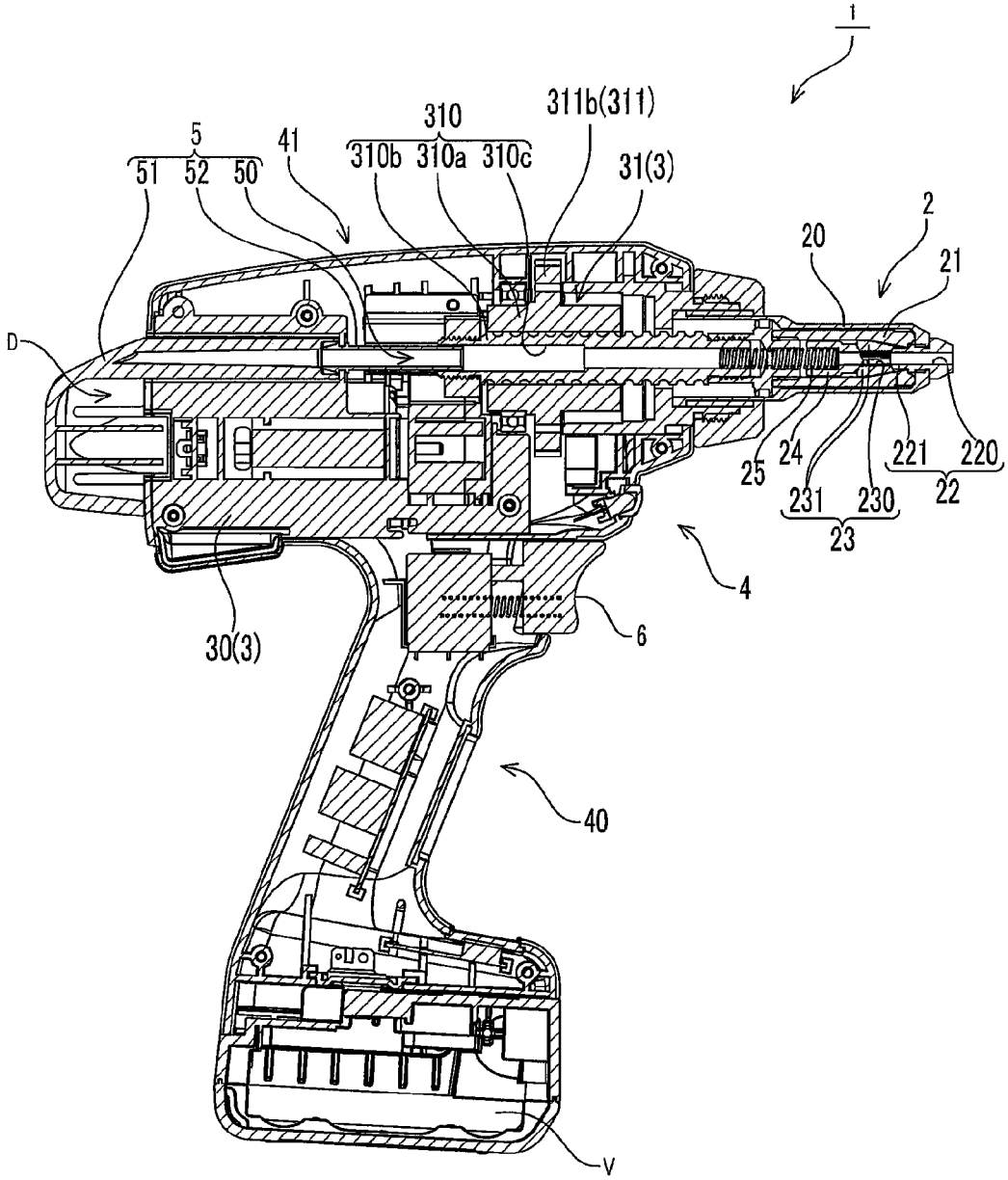
FIG. 4 is a sectional view, taken along the line A-A of FIG. 2, of the electric riveter according to the embodiment.

Specifically, as shown in FIG. 4, the actuator 2 includes a cylindrical cover 20 having a distal end and a proximal end, with the proximal end being coupled to the housing 4, a cylindrical jaw case 21 that has a distal end and a proximal end and is provided inside the cover 20 concentrically therewith so as to be movable along the center line of the cover 20, a nozzle 22 that is provided at the distal end of the cover 20 and includes a rivet shaft insertion hole 220 formed concentrically with the jaw case 21, and a jaw 23 that is provided inside the distal end of the jaw case 21 and is configured to be capable of cramping the mandrel. The actuator 2 according to this embodiment further includes a cylindrical jaw biasing part 24 having a first end and a second end on the opposite side of the first end, with the first end being abutted against the jaw 23, and a biasing spring 25 that biases the second end of the jaw biasing part 24 toward the jaw 23.

The proximal end of the cover 20 is coupled to the drive housing unit 41 so that the cover 20 extends in a direction intersecting the center of grip of the handle 40.

As described above, the jaw case 21 is provided inside the cover 20 concentrically therewith. Therefore, the jaw case 21 is configured to move along a direction in which the center line of the cover 20 extends while its outer circumferential surface is guided by the inner circumferential surface of the cover 20. That is, the jaw case 21 is configured to move in a direction intersecting the center line of the handle 40 (the center of grip).

Further, the inner circumferential surface of the distal end of the jaw case 21 (portion located on the distal end side of the cover 20) is composed of a tapered surface that is tapered toward the opening on the distal end side. Furthermore, the jaw case 21 has a proximal end coupled to an externally threaded member 310*b*, which will be described below, of the drive unit 3 concentrically therewith.

The rivet shaft insertion hole 220 of the nozzle 22 is continuous with the inside of the jaw 23. Thus, the electric riveter 1 is configured so that the mandrel inserted through the rivet shaft insertion hole 220 of the nozzle 22 reaches the jaw 23. The nozzle 22 further includes a jaw abutting portion 221 that projects into the cover 20 so as to be capable of abutting against the distal end of the jaw 23.

The jaw 23 is provided with a through hole 230 having a diameter slightly smaller than the outer diameter of the mandrel, so that the through hole 230 is concentric with the cover 20. Further, the jaw 23 is composed of a plurality of divided parts 231 formed by dividing a truncated cone (into two in this embodiment) along a direction in which the center line of the cover 20 extends.

As described above, the jaw 23 is provided inside the jaw case 21. Therefore, each of the pair of divided parts 231 that constitute the jaw 23 moves along the direction in which the center line of the cover 20 extends while its outer circumferential surface is guided by the inner circumferential surface of the jaw case 21. Therefore, the jaw 23 is configured so that the adjacent divided parts 231 move toward and away from each other as the jaw 23 moves along the direction in which the center line of the cover 20 extends.

The jaw biasing part 24 is arranged inside the jaw case 21 so as to be concentric with the jaw 23. Therefore, the jaw biasing part 24 is arranged so as to be concentric also with the jaw case 21 and the cover 20. Further, the internal space of the jaw biasing part 24 is continuous with the through hole 230 of the jaw 23. Furthermore, the jaw biasing part 24 is configured to be movable along the direction in which the center line of the cover 20 extends.

A coil spring is employed as the biasing spring 25. The biasing spring 25 is provided between the jaw biasing part 24 and the externally threaded member 310*b*, which will be described below, of the drive unit 3. Therefore, the jaw 23 is configured, as the jaw case 21 moves toward one side (the side on which the drive unit 3 is arranged) in the direction in which the center line of the cover 20 extends, to change its position with respect to the jaw case 21 toward the distal end side of the jaw case 21 due to the biasing force of the biasing spring 25 so as to clamp the mandrel by the pair of divided parts 231 moving close to each other. Further, the jaw 23 is configured, as the jaw case 21 moves toward the other side (the opposite side of the side on which the drive unit 3 is arranged) in the direction in which the center line of the cover 20 extends, to change its position with respect to the jaw case 21 toward the proximal end side of the jaw case 21 due to contact with the jaw abutting portion 221 of the nozzle 22 so as to release the clamping of the mandrel by the divided parts 231 moving away from each other.

Figure 5:
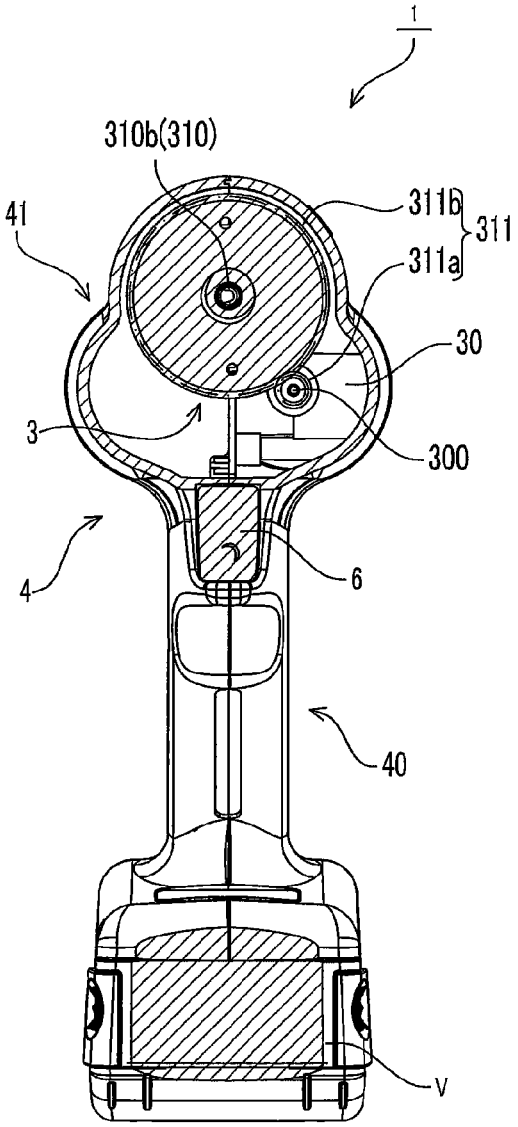
FIG. 5 is a sectional view, taken along the line B-B of FIG. 3, of the electric riveter according to the embodiment.

As shown in FIG. 4 and FIG. 5, the drive unit 3 includes an electric motor 30 having an output shaft 300, and a drive transmission mechanism 31 that transmits the driving force of the electric motor 30 to the actuator 2 so as to move the jaw case 21. The electric motor 30 is driven by power supplied from a power source V provided at the second end of the handle 40. Further, the electric motor 30 is configured so that, when it is driven, the output shaft 300 rotates about its axial core (see FIG. 5). The electric motor 30 is arranged so that the output shaft 300 is parallel to a feed screw mechanism 310.

The electric motor 30 is arranged at a position deviated from the center of grip of the handle 40 in the circumferential direction about the center line of the cover 20 (in the circumferential direction about a pin collection path, which will be described below). That is, the electric motor 30 is arranged at a position deviated from a range between the gripping position of the handle 40 and the feed screw mechanism 310 of the drive unit 3 in the circumferential direction about the center line of the cover 20. More specifically, the electric motor 30 is arranged at a position displaced within the range of 1 degree to 90 degrees, more preferably 25 degrees to 45 degrees, from the position of the center of grip of the handle 40 in the circumferential direction about the center line of the cover 20. In this embodiment, the electric motor 30 is arranged at a position displaced 36 degrees from the position of the center of grip of the handle 40 in the circumferential direction about the center line of the cover 20.

The drive transmission mechanism 31 includes the feed screw mechanism 310 that moves the jaw case 21 within the cover 20 (see FIG. 4). The feed screw mechanism 310 includes a cylindrical internally threaded member 310*a* and the externally threaded member 310*b* that is screwed into the internally threaded member 310*a* concentrically therewith.

The internally threaded member 310*a* has a screw hole in its inner circumferential portion. Further, the internally threaded member 310*a* is indirectly coupled to the output shaft 300 of the electric motor 30.

The externally threaded member 310*b* has a longitudinal shape in one direction. Further, the externally threaded member 310*b* has a first end and a second end on the opposite side of the first end in the longitudinal direction. The first end of the externally threaded member 310*b* is directly coupled to the proximal end of the jaw case 21 concentrically therewith. An externally threaded part is formed in the center of the externally threaded member 310*b* in the longitudinal direction. Furthermore, the externally threaded member 310*b* is provided with a communication hole 310*c* extending straight from the first end to the second end.

Thus, the drive transmission mechanism 31 is configured so that the externally threaded member 310*b* moves along a direction in which the center line of the externally threaded member 310*b* extends, as the internally threaded member 310*a* rotates.

As shown in FIG. 4, a spiral groove is formed on the inner circumferential surface of the internally threaded member 310*a*, and a spiral groove is formed also on the outer circumferential surface in the center of the externally threaded member 310*b* in the longitudinal direction. A plurality of ball members (not shown) are arranged between the groove of the internally threaded member 310*a* and the groove of the externally threaded member 310*b*. That is, the feed screw mechanism 310 is composed of a ball screw in which the externally threaded member 310*b* is screwed into the internally threaded member 310*a* via the balls.

Together with this, the drive unit 3 includes a gear mechanism 311 that transmits the driving force of the electric motor 30 to the internally threaded member 310*a*. In this embodiment, the drive unit 3 further includes a planetary gear mechanism 312 that transmits the driving force of the electric motor 30 to the gear mechanism 311.

As shown in FIG. 5, the gear mechanism 311 includes a first gear wheel 311*a* that is coupled to the planetary gear mechanism 312 (a support plate to be described below) (see FIG. 6), and a second gear wheel 311*b* that is attached to the internally threaded member 310*a*. The second gear wheel 311*b* is provided on the outer circumference of the internally threaded member 310*a* and is formed integrally with the internally threaded member 310*a* and concentrically therewith. In this embodiment, the first gear wheel 311*a* and the second gear wheel 311*b* directly mesh with each other.

Figure 6:
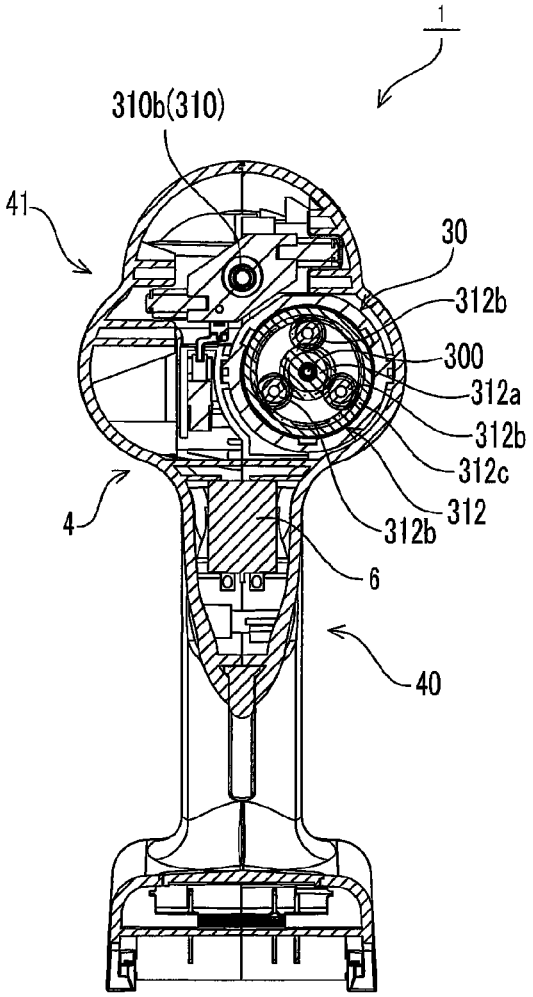
FIG. 6 is a sectional view, taken along the line C-C of FIG. 3, of the electric riveter according to the embodiment.

As shown in FIG. 6, the planetary gear mechanism 312 includes a sun gear 312*a* that is coupled to the output shaft 300 of the electric motor 30 concentrically therewith, a plurality of planetary gears 312*b* (in this embodiment, three planetary gears 312*b*) that directly mesh with the sun gear 312*a*, an inner gear wheel 312*c* that surrounds the plurality of planetary gears 312*b* and directly meshes with the plurality of planetary gears 312*b*, and a support plate (not shown) that pivotally supports each of the plurality of planetary gears 312*b* about its axis.

The support plate has a discoid shape. The first gear wheel 311*a* is coupled to one surface of the support plate concentrically therewith. On the other hand, the plurality of planetary gears 312*b* are arranged on the other surface of the support plate at predetermined intervals in the circumferential direction about the center of the support plate. The support plate is arranged concentrically with the sun gear 312*a* by the plurality of planetary gears 312*b* engaging with the sun gear 312*a*. This allows the sun gear 312*a* (the output shaft 300 of the electric motor 30) to be arranged concentrically with the first gear wheel 311*a*.

As the sun gear 312*a* rotates by receiving the driving force of the electric motor 30, the planetary gear mechanism 312 moves about the output shaft 300 of the electric motor 30 (the sun gear 312*a*) while each of the planetary gears 312*b* rotates about its own axial core. Following this, the support plate rotates concentrically with the output shaft 300 of the electric motor 30. Accordingly, the first gear wheel 311*a* rotates together with the support plate so as to rotate the internally threaded member 310*a*. Thus, the plurality of planetary gears 312*b* can rotate the first gear wheel 311*a* with a high torque.

The proximal end of the cover 20 is coupled to the drive housing unit 41 of the housing 4 so as to be concentric with the feed screw mechanism 310 housed therein. That is, the drive housing unit 41 has a first end and a second end on the opposite side of the first end in a direction intersecting the direction in which the center line of the handle 40 (the center of grip) extends. The proximal end of the cover 20 is coupled to the first end of the drive housing unit 41 so that the cover 20 is concentric with the feed screw mechanism 310.

The mandrel collector 5 includes a pin collection path 50 having a first opening end and a second opening end on the opposite side of the first opening end, and a collection tank 51 that houses mandrels. Further, the mandrel collector 5 further includes a collecting pipe 52 that has a longitudinal shape in one direction and partially constitutes the pin collection path.

The pin collection path 50 is configured to have a longitudinal shape along the direction in which the center line of the cover 20 extends. The pin collection path 50 has the first opening end opening into the jaw 23 and the second opening end communicating with an internal space D of the collection tank 51.

Specifically, the pin collection path 50 is formed collectively by the through hole 230 of the jaw 23, the inside of the jaw biasing part 24 (the inside of the biasing spring 25), the communication hole 310*c* of the externally threaded member 310*b*, and the inside of the collecting pipe 52 of the mandrel collector 5.

The collection tank 51 is configured to be detachable from the drive housing unit 41. Further, the collection tank 51 is attached to the drive housing unit 41 so that the second opening end of the pin collection path 50 is located above the center of the internal space D. Further, the collection tank 51 has a bottomed cylindrical shape and is configured to be attachable to and detachable from, on its opening side, the second end of the drive housing unit 41 of the housing 4.

The collection tank 51 is arranged at a position that is deviated from the center of grip of the handle 40 in the circumferential direction about the center line of the cover 20 and that avoids the electric motor 30. That is, the collection tank 51 is arranged at a position substantially symmetrical to the electric motor 30 with respect to the center line of the handle 40, as seen in the direction in which the center line of the cover 20 extends.

The collecting pipe 52 has a first end and a second end on the opposite side of the first end in the longitudinal direction. Further, the first end of the collecting pipe 52 is coupled to the second end of the externally threaded member 310*b* in the longitudinal direction concentrically therewith. The second end of the collecting pipe 52 is configured to extend to the outside of the drive housing unit 41. That is, the collecting pipe 52 is in the state of being inserted through the drive housing unit 41.

The electric riveter 1 further includes a trigger switch 6 provided on the first end side of the handle 40. The trigger switch 6 is configured to be switchable between the state where power is supplied from the power source V to the electric motor 30, and the state where the power supply from the power source V to the electric motor 30 is stopped, by being switched ON and OFF.

The electric riveter 1 according to this embodiment is as described above. Subsequently, the actuation of the electric riveter 1 having the aforementioned configuration is described.

The electric riveter 1 is operated to align the position of the rivet shaft insertion hole 220 of the nozzle 22 and the position of a mandrel that has been inserted through a rivet, in order to insert the mandrel inserted through the rivet into the rivet shaft insertion hole 220 of the nozzle 22. In the electric riveter 1, when the mandrel is inserted through the rivet shaft insertion hole 220 of the nozzle 22, the mandrel reaches the through hole 230 of the jaw 23.

In such a state, an operator operates the trigger switch 6, and power is supplied to the electric motor 30, so that the output shaft 300 of the electric motor 30 rotates. In conjunction with the output shaft 300 of the electric motor 30, the planetary gear mechanism 312, the gear mechanism 311, and the externally threaded member 310*b* are actuated. This causes the externally threaded member 310*b* to move toward one side in the direction in which the center line of the cover 20 extends.

Once the externally threaded member 310*b* starts to move, the jaw case 21 moves, in conjunction with the externally threaded member 310*b*, from the distal end side of the cover 20 toward the proximal end side of the cover 20 along the direction in which the center line of the cover 20 extends. In such a state, the jaw 23 is biased to the distal end of the cover 20. Therefore, after the jaw case 21 has moved a predetermined amount, the jaw 23 starts to move together with the jaw case 21.

That is, when the jaw case 21 has moved a predetermined amount, the jaw 23 changes its position toward the distal end side of the jaw case 21 due to the biasing force of the biasing spring 25 so as to clamp the mandrel. Then, the jaw case 21 subsequently moves further, thereby allowing the jaw 23 to move from the distal end side of the cover 20 to the proximal end side of the cover 20 (operated to be withdrawn) along the direction in which the center line of the cover 20 extends, with the jaw 23 clamping the mandrel. The operation to withdraw the jaw 23 that is clamping the mandrel causes the mandrel to be withdrawn from the rivet (the rivet to be crimped).

Further, when the jaw 23 returns to the distal end side of the cover 20 (when it returns to the original position at which it can clamp the mandrel), the jaw 23 comes in contact with the nozzle 22 and releases the clamping of the mandrel that has been withdrawn from the rivet. Then, the mandrel withdrawn from the rivet is introduced into the pin collection path 50 and is housed in the internal space D of the collection tank 51.

As described above, according to the electric riveter 1 of this embodiment, the electric motor 30 is arranged at a position deviated from the center of grip of the handle 40 in the circumferential direction about the direction in which the center line of the cover 20 extends, and thus the electric motor 30 does not intervene between the gripping position of the handle 40 and the feed screw mechanism 310 of the drive unit 3. Therefore, the gripping position of the handle 40 and the position through which the mandrel is inserted (the position of the rivet shaft insertion hole 220 of the nozzle 22) are arranged close to each other. Therefore, the nozzle 22 can easily access the position where a member subject to riveting is fastened (i.e., the position of the rivet with the mandrel inserted into the rivet shaft insertion hole 220 through the nozzle 22) Accordingly, it is possible to exert an excellent effect of being capable of improving operability, in addition to being capable of collecting mandrels that are withdrawn when rivets are crimped.

Further, the electric motor 30 and the collection tank 51 are arranged at a position substantially symmetrical to each other with respect to the center line of the handle 40, as seen in the direction in which the center line of the cover 20 extends. Moreover, the first gear wheel 311*a* is coupled to the output shaft 300 of the electric motor 30 via the planetary gear mechanism 312. In this way, the planetary gear mechanism 312 serves as a reduction mechanism in the drive housing unit 41, and thus the space occupied by the reduction mechanism in the drive housing unit 41 is reduced. Accordingly, it is possible to shorten the dimension in a direction in which the pin collection path 50 extends. In addition, since the actuator 2 is allowed to have a high torque despite its small size, it is possible to withdraw the mandrel from the rivet efficiently. Accordingly, the gripping position of the handle 40 and the position through which the mandrel is inserted are arranged closer to each other, and thus the operability can be improved more.

Furthermore, since the collection tank 51 is attached to the drive housing unit 41 so that the other end of the collecting pipe 52 is located above the center of the internal space D of the collection tank 51, it is possible to prevent mandrels that are collected within the internal space D of the collection tank from closing the other end side of the collecting pipe 52. Accordingly, it is possible to perform riveting continuously without the need to frequently perform an operation to dispose of the mandrels. Further, it is also possible to dispose of the mandrels housed in the internal space D of the collection tank by detaching the collection tank 51 from the drive housing unit 41.

It should be noted that the electric riveter according to the present invention is not limited to the above described embodiments. It is a matter of course that various modifications can be made without departing from the gist of the present invention.

In the above described embodiments, the electric motor 30 is arranged at a position displaced 36 degrees from the position of the center of grip of the handle 40 in the circumferential direction about the center line of the cover 20. However, there is no limitation to this.

Further, the jaw 23 is composed of the two divided parts 231 in the above described embodiments. However, there is no limitation to this. For example, the jaw 23 may be composed of three or more divided parts 231.

Further, the externally threaded member 310*b* of the feed screw mechanism 310 is coupled to the jaw case 21 concentrically therewith in the above described embodiments. However, there is no limitation to this. For example, the internally threaded member 310*a* may be coupled to the jaw case 21 concentrically therewith. In such a case, the externally threaded member 310*b* is required to be coupled directly or indirectly to the output shaft 300 of the electric motor 30.

Further, the first gear wheel 311*a* and the second gear wheel 311*b* directly mesh with each other in the above described embodiments. However, there is no limitation to this. For example, the first gear wheel 311*a* and the second gear wheel 311*b* may mesh with each other via an intermediate gear wheel.

Further, the feed screw mechanism 310 is composed of a ball screw in which the externally threaded member 310*b* is screwed into the internally threaded member 310*a* via the balls in the above described embodiments. However, there is no limitation to this. For example, the externally threaded member 310*b* may be directly screwed into the internally threaded member 310*a*.

Further, the gear mechanism 311 is coupled to the output shaft 300 of the electric motor 30 via the planetary gear mechanism 312 in the above described embodiments. However, there is no limitation to this. For example, the gear mechanism 311 may be coupled directly to the output shaft 300 of the electric motor 30.

REFERENCE SIGNS LIST

1: Electric Riveter
2: Actuator
3: Drive Unit
4: Housing
5: Mandrel Collector
6: Trigger Switch
20: Cover
21: Jaw Case
22: Nozzle
23: Jaw
24: Jaw Biasing Part
25: Biasing Spring
30: Electric Motor
31: Drive Transmission Mechanism
40: Handle
41: Drive Housing Unit
50: Pin Collection Path
51: Collection Tank
52: Collecting Pipe
220: Rivet Shaft Insertion Hole
221: Jaw Abutting Portion
230: Through Hole
231: Divided Parts
300: Output Shaft
310: Feed Screw Mechanism
310*a*: Internally Threaded Member
310*b*: Externally Threaded Member
310*c*: Communication Hole
311: Gear Mechanism
311*a*: First Gear Wheel
311*b*: Second Gear Wheel
312: Planetary Gear Mechanism
312*a*: Sun Gear
312*b*: Planetary Gear
312*c*: Inner Gear Wheel
D: Internal Space of Collection Tank
V: Power Source

The invention claimed is:

1. An electric riveter comprising:

an actuator for withdrawing a mandrel inserted through a rivet to enable the rivet to be crimped;

a drive unit for driving the actuator;

a housing internally provided with the actuator and the drive unit; and a mandrel collector for collecting the mandrel withdrawn from the rivet;

wherein the actuator comprises:

a cylindrical cover having a distal end and a proximal end;

a cylindrical jaw case having a distal end and a proximal end, the jaw case being provided inside the cover concentrically therewith so as to be movable along a direction in which a center line of the cover extends;

a nozzle provided at the distal end of the cover, the nozzle having a rivet insertion hole that is formed concentrically with the jaw case; and jaws provided inside the distal end of the jaw case, the jaws being capable of clamping the mandrel;

further wherein the drive unit comprises:

an electric motor; and a drive transmission mechanism for transmitting a driving force of the electric motor to the actuator so as to move the jaw case;

further wherein the housing comprises:

a handle having a first end and a second end on the opposite side of the first end, wherein a center of grip of the handle comprises a longitudinal axis of the handle between the first end and the second end; and a drive housing unit for housing the drive unit, the drive housing unit being connected to the first end of the handle, wherein the proximal end of the cover is coupled to the drive housing unit so that the cover extends in a direction intersecting the center of grip of the handle;

further wherein the mandrel collector comprises:

a pin collection path defined between at least the jaws and a collecting pipe, the pin collection path having a first opening end and a second opening end on the opposite side of the first opening end; and a collection tank for housing the mandrel, the collection tank having an internal space defined by at least one interior surface of the collection tank, and wherein the pin collection path has the first opening end opening into the jaws and the second opening end communicating with the internal space of the collection tank; and further wherein the electric motor of the drive unit is arranged at a position deviated from the center of grip of the handle along a plane orthogonal to an axis of the pin collection path the collection tank is arranged at a position deviated from the center of grip of the handle along the plane orthogonal to the axis of the pin collection path, and the electric motor and the collection tank are arranged side by side, with the center of grip of the handle being located therebetween.

2. The electric riveter according to claim 1, wherein the collection tank is attachable to and detachable from the drive housing unit, and is attached to the drive housing unit so that the second opening end of the pin collection path is located above a center of the internal space of the collection tank.

* * * * *